US007615742B2

(12) United States Patent
Brekenfeld

(10) Patent No.: US 7,615,742 B2
(45) Date of Patent: Nov. 10, 2009

(54) MEASUREMENT OF LIGHT FRAGMENT IONS WITH ION TRAPS

(75) Inventor: Andreas Brekenfeld, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 426 days.

(21) Appl. No.: 11/442,657

(22) Filed: May 26, 2006

(65) Prior Publication Data

US 2006/0289738 A1 Dec. 28, 2006

(30) Foreign Application Priority Data

Jun. 3, 2005 (DE) ..... 10 2005 025 497

(51) Int. Cl.
*H01J 49/42* (2006.01)

(52) U.S. Cl. ..... 250/282; 250/281; 250/290; 250/291; 250/292; 250/293

(58) Field of Classification Search ..... 250/281–300
See application file for complete search history.

(56) References Cited

U.S. PATENT DOCUMENTS

| | | | | |
|---|---|---|---|---|
| 4,686,367 | A * | 8/1987 | Louris et al. | 250/290 |
| 4,736,101 | A * | 4/1988 | Syka et al. | 250/292 |
| 4,818,869 | A * | 4/1989 | Weber-Grabau | 250/282 |
| 5,198,665 | A * | 3/1993 | Wells | 250/282 |
| 5,420,425 | A * | 5/1995 | Bier et al. | 250/292 |
| 5,466,931 | A * | 11/1995 | Kelley | 250/282 |
| 5,654,542 | A * | 8/1997 | Schubert et al. | 250/282 |
| 5,714,755 | A * | 2/1998 | Wells et al. | 250/281 |
| 6,147,348 | A * | 11/2000 | Quarmby et al. | 250/292 |
| 6,410,913 | B1 * | 6/2002 | Brekenfeld et al. | 250/282 |
| 6,852,972 | B2 * | 2/2005 | Baba et al. | 250/292 |
| 6,949,743 | B1 * | 9/2005 | Schwartz | 250/290 |
| 7,034,293 | B2 * | 4/2006 | Wells | 250/292 |
| 7,102,129 | B2 * | 9/2006 | Schwartz | 250/292 |
| 7,227,137 | B2 * | 6/2007 | Londry et al. | 250/292 |
| 2002/0175280 | A1 * | 11/2002 | Franzen | 250/283 |
| 2003/0150988 | A1 * | 8/2003 | Wells | 250/292 |
| 2004/0079873 | A1 * | 4/2004 | Bateman et al. | 250/281 |
| 2004/0079880 | A1 * | 4/2004 | Bateman et al. | 250/288 |

(Continued)

FOREIGN PATENT DOCUMENTS

| | | |
|---|---|---|
| DE | 44 25 384 C1 | 11/1995 |

(Continued)

*Primary Examiner*—David A Vanore
*Assistant Examiner*—Michael J Logie
(74) *Attorney, Agent, or Firm*—Law Offices of Paul E. Kudirka

(57) ABSTRACT

The invention relates to methods for the measurement of fragment ion spectra in ion trap mass spectrometers in which fragment ions below a cut-off mass cannot normally be measured. The invention consists in measuring mass spectra including light fragment ions by briefly conducting the collisionally induced fragmentation—which is always brought about by a large number of collisions—at an unusual high RF storage voltage, which produces collisions more energetically than by conventional fragmentation, and then switching the RF voltage to a low RF voltage in a fast but controlled procedure. In this way light fragment ions are produced by double cleavages from metastable fragment ions with a certain half-life time. Since the cut-off mass for the storage capability is proportional to the RF storage voltage, reducing the RF storage voltage means that the light fragment ions can also be kept and measured in the ion trap.

9 Claims, 7 Drawing Sheets

U.S. PATENT DOCUMENTS

| | | | | |
|---|---|---|---|---|
| 2004/0119015 | A1* | 6/2004 | Hashimoto et al. | 250/292 |
| 2005/0178963 | A1* | 8/2005 | Londry et al. | 250/293 |
| 2005/0258362 | A1* | 11/2005 | Collings | 250/290 |
| 2005/0263695 | A1* | 12/2005 | Syka | 250/291 |
| 2005/0274887 | A1* | 12/2005 | Weiss et al. | 250/292 |
| 2005/0274902 | A1* | 12/2005 | Weiss | 250/423 R |
| 2006/0054808 | A1* | 3/2006 | Schwartz | 250/290 |
| 2006/0169884 | A1* | 8/2006 | Syka | 250/282 |
| 2006/0192112 | A1* | 8/2006 | Mordehal | 250/290 |

FOREIGN PATENT DOCUMENTS

| | | | |
|---|---|---|---|
| EP | 0 579 935 | B1 | 1/1994 |
| EP | 0 580 986 | A1 | 2/1994 |
| EP | 1 463 090 | A1 | 9/2004 |
| GB | 2 363 249 | A | 12/2001 |
| WO | WO 95/18669 | A1 | 7/1995 |
| WO | WO 2006/031896 | A1 | 3/2006 |

* cited by examiner

MEASUREMENT OF LIGHT FRAGMENT IONS WITH ION TRAPS

FIELD OF THE INVENTION

The invention relates to methods for the measurement of fragment ion spectra in ion trap mass spectrometers in which fragment ions below a cut-off mass cannot normally be measured.

BACKGROUND OF THE INVENTION

Paul ion trap mass spectrometers comprise a hyperbolic ring electrode and two rotationally symmetric hyperbolic end cap electrodes. If an electric voltage is applied to the end caps, on the one hand, and to the ring electrode, on the other, an essentially quadrupole field is generated in the interior. If the voltage is an RF voltage, then the RF electric field created is able to store ions. For practical reasons, it is usually the case that this RF storage voltage is only applied to the ring electrode, while the end cap electrodes are kept at ground potential. The RF storage voltage has a frequency which is usually around one megahertz.

According to Hans Dehmelt, the RF storage field can be envisaged as a pseudopotential well with a parabolic potential minimum in the center; the ions in the potential well are able to orbit on ellipses or oscillate through the center. The pseudopotential is a temporal integration over the square of the field intensity; the gradient of the pseudopotential continually drives the ions back to the center of the ion trap.

The ions are only stored when they have a mass above a cut-off mass, however. The term "mass" here is always to be understood as the charge-related mass m/z, as is required in mass spectrometry, i.e., the physical mass m divided by the number z of the (positive or negative) elementary charges. Ions below the cut-off mass are so light that during one half-phase of the RF storage voltage they can already be accelerated up to the opposite electrodes; temporal integration is no longer possible for them.

The remaining ions oscillate in the pseudopotential well in the ion trap, the oscillation frequencies being roughly inversely proportional to their mass. There are good approximation formulae for the relationship between mass and oscillation frequency. The oscillation frequencies are one characteristic for the mass; for example, the oscillations of the ions can be resonantly excited with very accurate mass selectivity.

If the ion trap is filled with a collision gas at a pressure between $10^1$ and $10^3$ Pascal, then the oscillations of the ions in the potential well are damped within a short time in such a way that the ions collect in a small cloud in the minimum of the potential well. The size of the cloud is determined by the Coulomb repulsion between the ions themselves, on the one hand, and by the centrally-directed force of the pseudopotential, on the other. The time required by the damping is inversely proportional to the pressure of the collision gas. At a pressure of around $10^2$ Pascal, the time up to the damping is a few milliseconds; the ion undergoes a few hundred collisions in this time.

To measure fragment ion spectra in ion trap mass spectrometers, it is necessary to first select an ion species which one wishes to fragment into fragment ions and then measure. The fragment ions (of the first generation of fragmentations) are frequently termed "daughter ions", and the ion species to be selected for the fragmentation is frequently termed "parent ions". After selecting the parent ions, all other ions located in the ion trap are ejected from it so that only the parent ions remain. The parent ions do not have to have precisely the same mass; they can also be the different ions which have the same molecular formula of the elemental composition but include all the various isotopic combinations.

The process of ejecting all ions not selected is frequently termed "isolation" of the parent ions. The basic principles of the ejection are largely known and can easily be conducted in all commercially available ion trap mass spectrometers. It is based, on the one hand, on using the lower mass limit to eject the ions that are lighter than the parent ions and, on the other, using a mass-selective resonant excitation of the oscillations of the undesired heavier ions; the excitation process used is so strong that the ions touch the electrodes and are thus discharged or otherwise disappear from the ion trap. The resonant excitation is usually brought about by an alternating voltage applied across the two end cap electrodes.

The remaining parent ions collect again in a small cloud in the center of the ion trap as a result of the damping in the collision gas. They can now be fragmented. The usual type of fragmentation is collisionally induced decomposition (CID). The relatively soft resonant excitation forces them to oscillate, leading to a large number of low-energy collisions with the collision gas. In many of these collisions, small portions of energy are transferred into the internal structure of the parent ions. The intrinsic energy of the internal molecular oscillation systems increases until one of the weaker bonds within the molecular structure of the parent ion breaks open. A singly charged parent ion forms a daughter ion and a neutral particle; a doubly charged parent ion frequently (but not always) forms two singly charged daughter ions. Since the daughter ions are no longer resonantly excited because they have a different mass and hence a different oscillation frequency, their oscillations are cooled by the collision gas from the moment of cleavage; the daughter ions collect in the center in a small cloud and, according to the present view, do not decompose further. They can then be measured as a daughter ion spectrum in the conventional way by being resonantly and selectively ejected in sequence according to their mass in a detector located outside the ion trap.

Investigations with other types of mass spectrometer have shown that with the harder collision fragmentations used there, not only are two fragment ions created each time, but that these fragment ions can certainly decompose further, presumably in further fragmentation processes or as a result of metastable decomposition, creating granddaughter ions.

We now turn to a field of application in which mass spectrometry plays an important role: proteomics. This frequently involves enzymatic breaking down the proteins to digest peptides, and analyzing the latter by mass spectrometry. If one begins with peptide ions, then so-called internal fragments form in the collision cells; these fragments originate from two cleavages of the chain of amino acids. The incidence of so-called immonium ions here is particularly high; these are charged single amino acids originating from somewhere in the chain. The measurement of such immonium ions has high informational value since they immediately signalize the presence of this amino acid in the peptide. It is frequently possible to read off the amino acid composition of the peptide from the immonium ions, even if it is not possible to thus determine the arrangement of the amino acids along the chain.

It has unfortunately not yet proven possible to measure these immonium ions in ion trap mass spectrometers. If the RF storage voltage used during the fragmentation were low enough for immonium ions to remain in the ion trap after their creation, then the resonant excitation of the parent ions would have to be so weak that they could absorb practically no energy in the collisions; in any case, the cooling effect caused by the collisions is then stronger than the effect of the energy absorption, and no fragmentation occurs. In the case of stronger resonant excitation, the parent ions would then be accelerated as far as the electrodes and they would disappear out of the ion trap.

For fragmentation, the RF storage voltage therefore always has to be quite high, as otherwise there will be no fragmentation. That is a dilemma. The high RF storage voltage produces a high cut-off mass for the storage, and the immonium ions (if they are created at all) cannot be retained. It is usual to choose an RF storage voltage for the fragmentation where the lower cut-off mass for the storage capability is around a third of the mass of the parent ions. It is therefore not only the immonium ions but also smaller ions which are lost from two, three or four amino acids, depending on the size of the peptide.

In a similar way to the immonium ions, other types of light ions produced by fragmentations can also provide information about the structures of the parent ions which is otherwise very difficult to obtain. For example, methods have recently been elucidated which are directed at splitting off ionized derivatization groups (side chains) which have not yet been able to be detected in ion traps using the methods which have been usual until now.

SUMMARY OF THE INVENTION

The invention basically consists in conducting the fragmentation for a short time of between a few tenths of a millisecond and a few milliseconds only at a considerably higher RF storage voltage than normal and then switching to a low RF storage voltage in a controlled way. When using the high RF storage voltage for the fragmentation, it is possible to work with either a resonant excitation or with a deflection of the parent ions far out of the center by using DC potentials across the end cap electrodes. Already in the deflection mode, the forced oscillation of the ions in the high RF field near to the end cap bring about hard collisions for a fragmentation; when the deflection DC voltage is switched off the strongly retroactive force of the pseudopotential acts on the ions, so that the ions undergo fast oscillations through the ion trap and thus powerful collisions with the collision gas. With the subsequent low RF storage voltage the fragment ions, which also include very light daughter ions and granddaughter ions, then collect in the center of the ion trap and can be measured in the normal way.

The DC voltage can preferably be a potential difference across the two end caps. The deflection of the cloud of parent ions then occurs in closed form toward the attracting end cap. A further modification of the above fragmentation methods consists in first using an RF excitation or a DC voltage to bring the ions close to the electrodes at a moderately high RF storage voltage, and then briefly increasing the RF storage voltage.

Both methods, those with resonant RF excitation voltage as well as those with non-resonant DC potentials, are successful and provide fractions of light daughter ions which can be evaluated.

BRIEF DESCRIPTION OF THE DRAWINGS

The above and further advantages of the invention may be better understood by referring to the following description in conjunction with the accompanying drawings in which.

DETAILED DESCRIPTION

Figure 5:
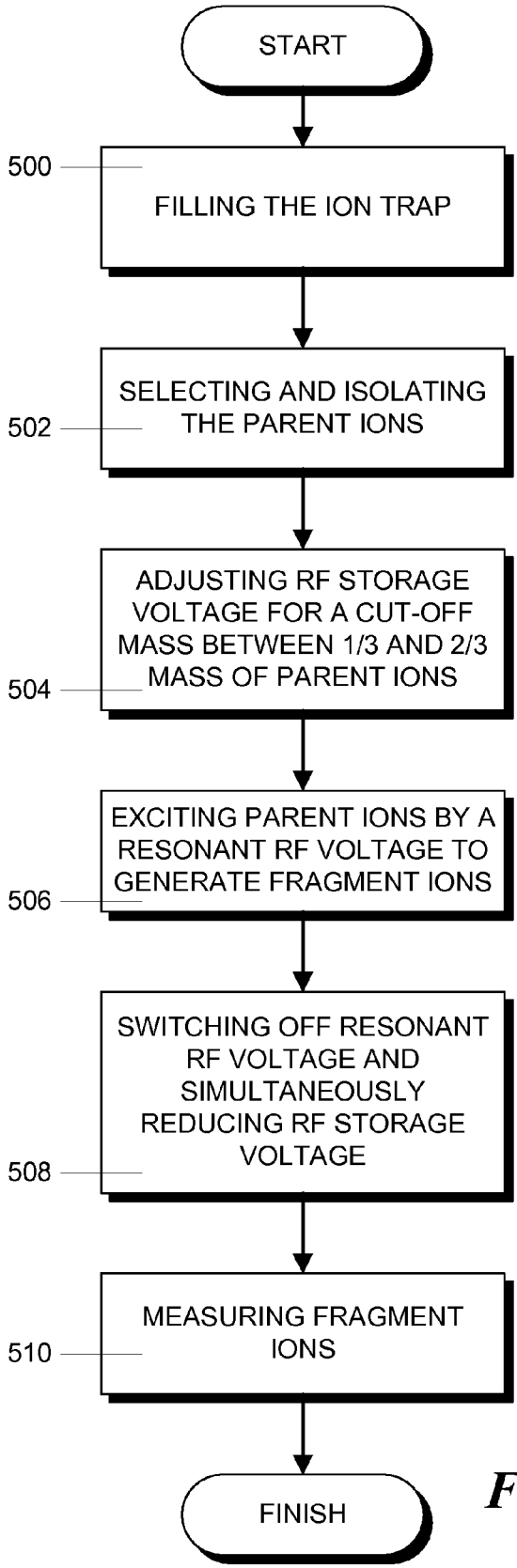
FIG. 5 is a flowchart showing the steps in an illustrative process for measuring light fragment ions in accordance with the invention.

A first favorable embodiment is shown in FIG. 5. The trap is first filled in step 500 and the parent ions are selected and isolated in step 502 in a conventional fashion. Then, the method continues in step 504 by applying an unusually high RF storage voltage, which is chosen so that the cut-off mass for the ion storage is between one third and two thirds of the mass of the parent ions. In step 506, a resonant RF excitation is then applied to both end cap electrodes which excites the oscillations of the parent ions until they come close to the end cap electrodes. In step 508, the RF excitation voltage is then switched off and simultaneously the RF storage voltage is reduced in a controlled way to values which generate a cut-off mass for the ion storage which is capable of holding the light daughter ions that are to be detected. To detect immonium ions, the cut-off mass should then be around 55 Daltons (the lightest protonated amino acid has the mass 59 Daltons). If the RF storage voltage were switched too rapidly to the low value, then the oscillating ions would—owing to the removal of the retroactive force and due to the high kinetic energy of the ions themselves—immediately increase their oscillation widths until they impinge at the end cap electrodes and be lost to the process; in any event this would happen when they are just at the maximum of their kinetic energy, i.e., roughly in the center of the ion trap. Those ions which are at the maximum of their potential energy, i.e., near to the electrodes, also experience a reduction of their potential energy when the RF storage voltage is reduced, so these ions would not get lost. Since the oscillating parent ions do not all move in phase, if only because, as an isotope group, they do not all have exactly the same mass, it is necessary, in summary, to reduce the RF storage voltage only at a rate that allows the damping by the damping gas—which steadily reduces the oscillation amplitudes of the parent ions—to keep the oscillations at amplitudes which are less than the separation of the end caps. The light fragment ions are then measured in step 510.

The unusually high RF storage voltage is selected so as to generate by far more energetic collisions than are possible with the usual method. The RF storage voltage used here is preferably high enough that the cut-off mass for the ion storage is half to roughly two-thirds of the mass of the parent ions.

Good experimental results are obtained if the cut-off mass is around half of the mass of the parent ions. It must be borne in mind that at high RF storage voltages the forced oscillations imposed on the exciting oscillations in the pseudopotential well have themselves relatively large amplitudes as a result of the RF field. In an RF storage field in which parent ions oscillate a little above the cut-off mass, the amplitudes of the imposed forced oscillations are roughly the same size as the amplitudes of the oscillations in the pseudopotential well. The imposed forced oscillations have a very high energy and assist with the fragmentation.

The speed with which the RF storage voltage is powered down to low values is determined by the pressure of the collision gas, i.e., by the strength of the damping. This usually only requires between a few tenths of a millisecond and a few milliseconds. The RF storage voltage can simply be powered down linearly, or using other functions, for example an exponential creeping to the lower value.

Figure 1:
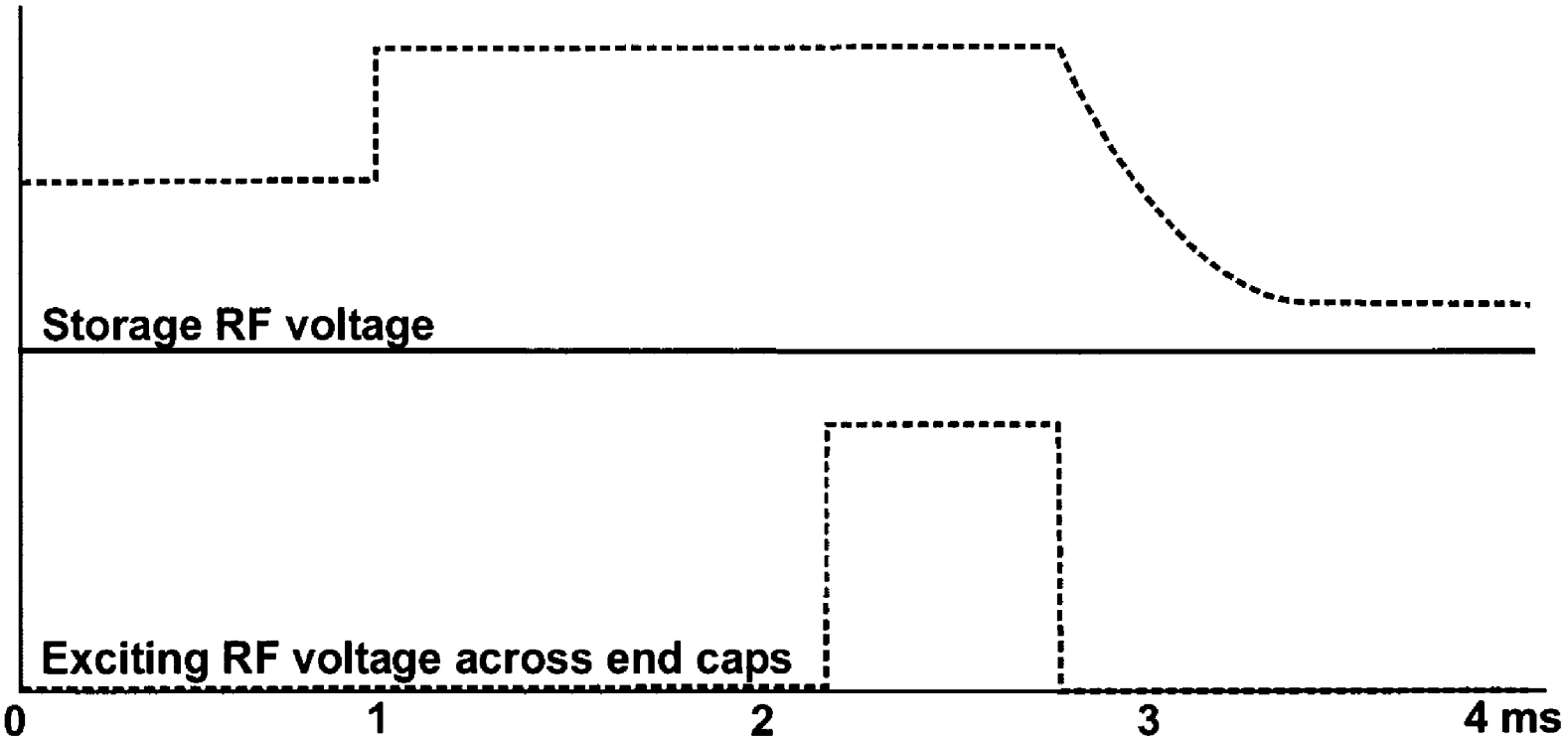
FIG. 1 is a diagram of the RF storage voltage (top) and the resonant RF excitation voltage (below) over the period of the fragmentation phase. After switching off the excitation, which only lasts a few tenths of a millisecond, the RF storage voltage is also powered down in a controlled way to a value which makes it possible to store light ions.
Figure 2:
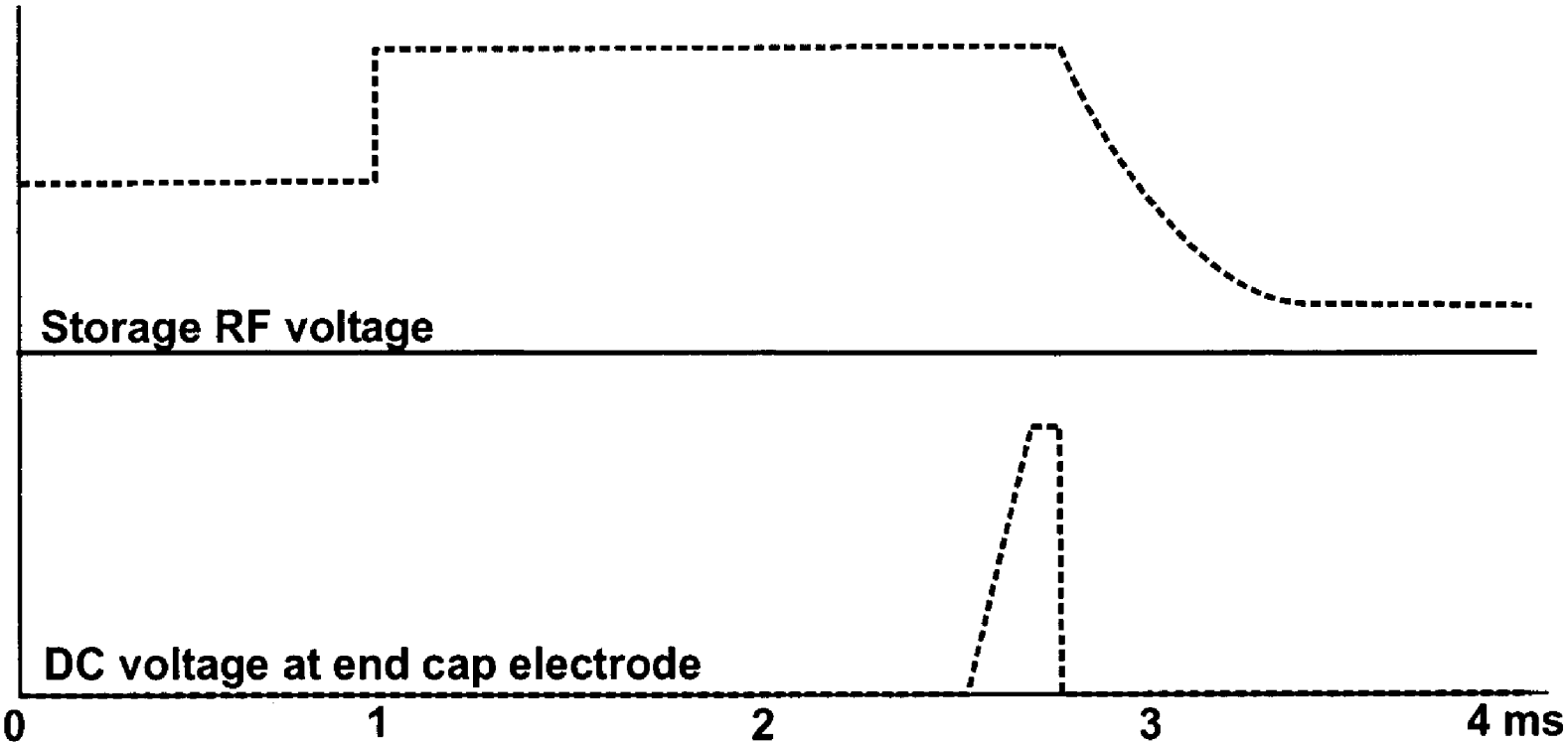
FIG. 2 is a similar diagram, but uses a deflecting DC voltage which is applied across the end cap electrodes. This deflects the ion cloud out of the center; after the DC voltage is switched off, the ions oscillate with some energy, which is expended in collisions; and when the DC voltage is switched off the controlled powering down of the RF storage voltage begins.
Figure 3:
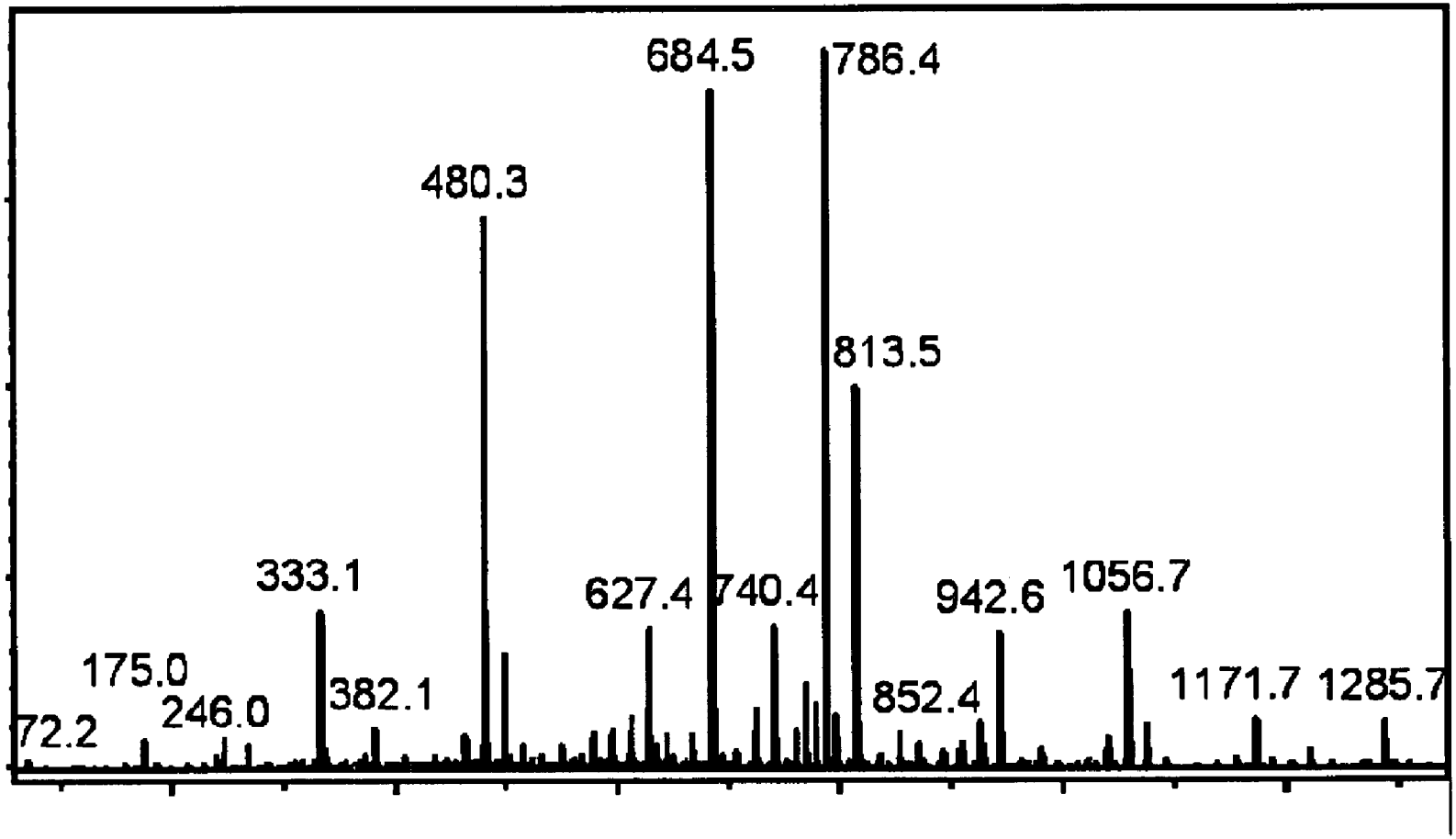
FIG. 3 illustrates a mass spectrum obtained according to the method shown in FIG. 1. It illustrates the immonium ions which cannot otherwise be measured.
Figure 4:
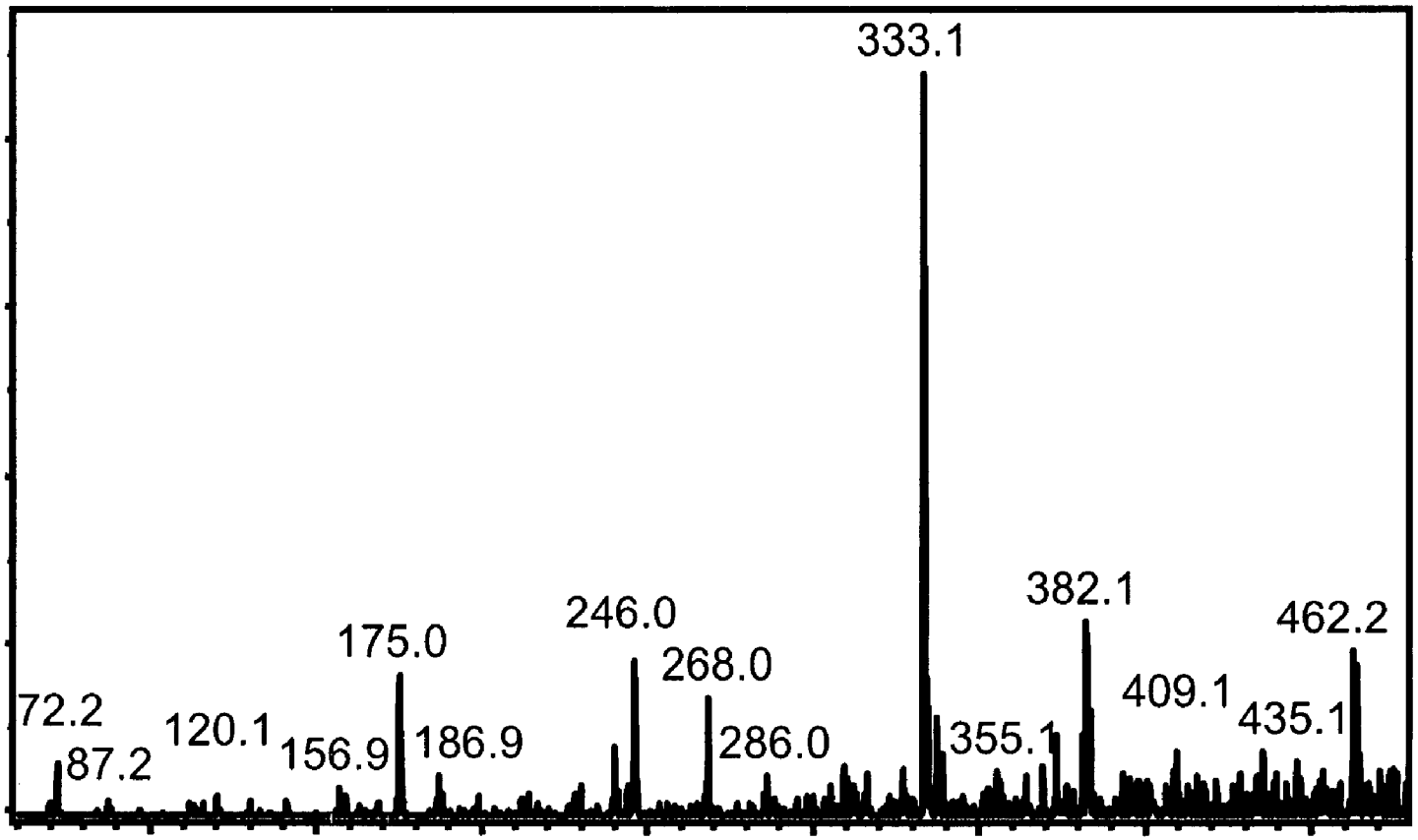
FIG. 4 represents a section of the mass spectrum in FIG. 3, where the immonium ions can be more clearly seen.

The spectrum from FIG. 3 with the section from FIG. 4 was recorded in this way. The ion signals of the immonium ions can be clearly seen. The sensitivity of this scanning method according to the invention for daughter ion spectra is only slightly lower than with the conventional type of method, but it depicts the light daughter ions, which have a high informational value but cannot otherwise be measured. The specialist should note that the fragmentation pattern for peptide ions which is produced by normal fragmentation methods in ion traps, and which contains very high proportions of b-ions and b-18-ions, shifts slightly in favor of y-ions. This can equally be exploited to identify the peptides.

Even while the RF storage voltage is being reduced, it is quite possible to continue to excite the ions to oscillate with an (also diminishing) RF excitation voltage, but it is difficult to hold the parent ions in resonance because the change to the RF storage voltage also changes the frequency of the ion oscillations. The frequency of the RF excitation voltage would therefore also have to change continuously. Since the above-described method of suddenly switching off the excitation already achieves good results, a further excitation of this type does not seem necessary.

Figure 6:
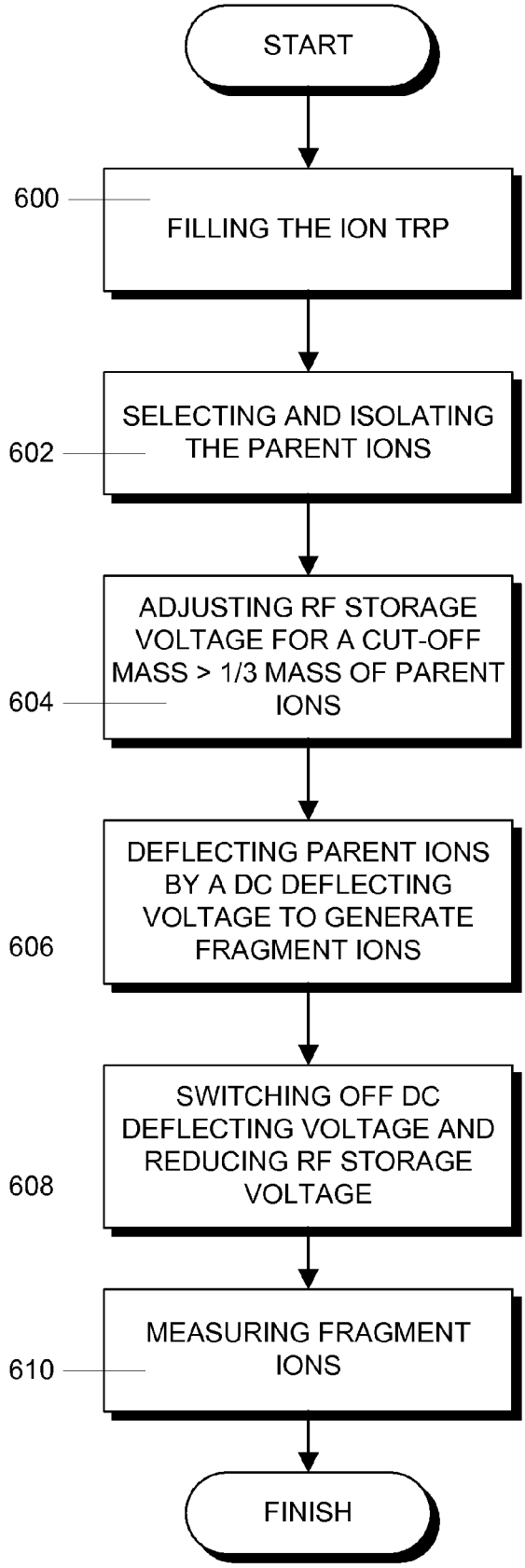
FIG. 6 is a flowchart showing the steps in an alternative process for measuring light fragment ions in accordance with the invention.

The second, even more favorable embodiment is shown in FIG. 6 and also begins with the steps 600 and 602 of filling the trap with ions and selecting and isolating the parent ions. The method then continues in step 604 with the application of an RF storage voltage having a value such that the cutoff mass of the trap is greater than one third of the mass of the parent ions, which is unusually high for fragmentation methods. However, no resonant RF excitation voltage is used at the end cap electrodes; instead, in step 606, a DC voltage is simply applied to one of the end cap electrodes causing the cloud of parent ions to be drawn (or pushed) toward one of the end cap electrodes. There is then an equilibrium between the attractive effect of the DC fields and the repulsive effect of the pseudopotential gradient; however, the individual ions of the cloud are subject to a stronger imposed forced oscillation with the storage RF than at the rest position of the cloud in the center of the ion trap. This imposed forced oscillation already leads to large numbers of collisions with the collision gas and hence to the beginning of the fragmentation. The cloud should therefore not be maintained in this deflected state for very long; only a few tenths of a millisecond or even less are necessary. If, in step 608, the DC voltage is now switched off, then the ions in the cloud oscillate alternately between high potential and high kinetic energy through the ion trap, driven by the high gradient of the pseudopotential in the ion trap. If switched off at the right phase of the storage RF, then there is no danger that they will hit the end caps because their energy is insufficient for this. They undergo relatively high-energy collisions and their oscillation is slowly damped. In a way similar to that of the first embodiment, the amplitude of the RF storage voltage is powered down in a controlled way, until a state is reached in which the light ions to be detected can be held in the ion trap. The light fragment ions are then measured in step 610.

Switching off the DC voltage here has to take into account the phase of the imposed forced oscillations of the parent ions since their amplitudes and kinetic energies are no longer negligible.

Figure 7:
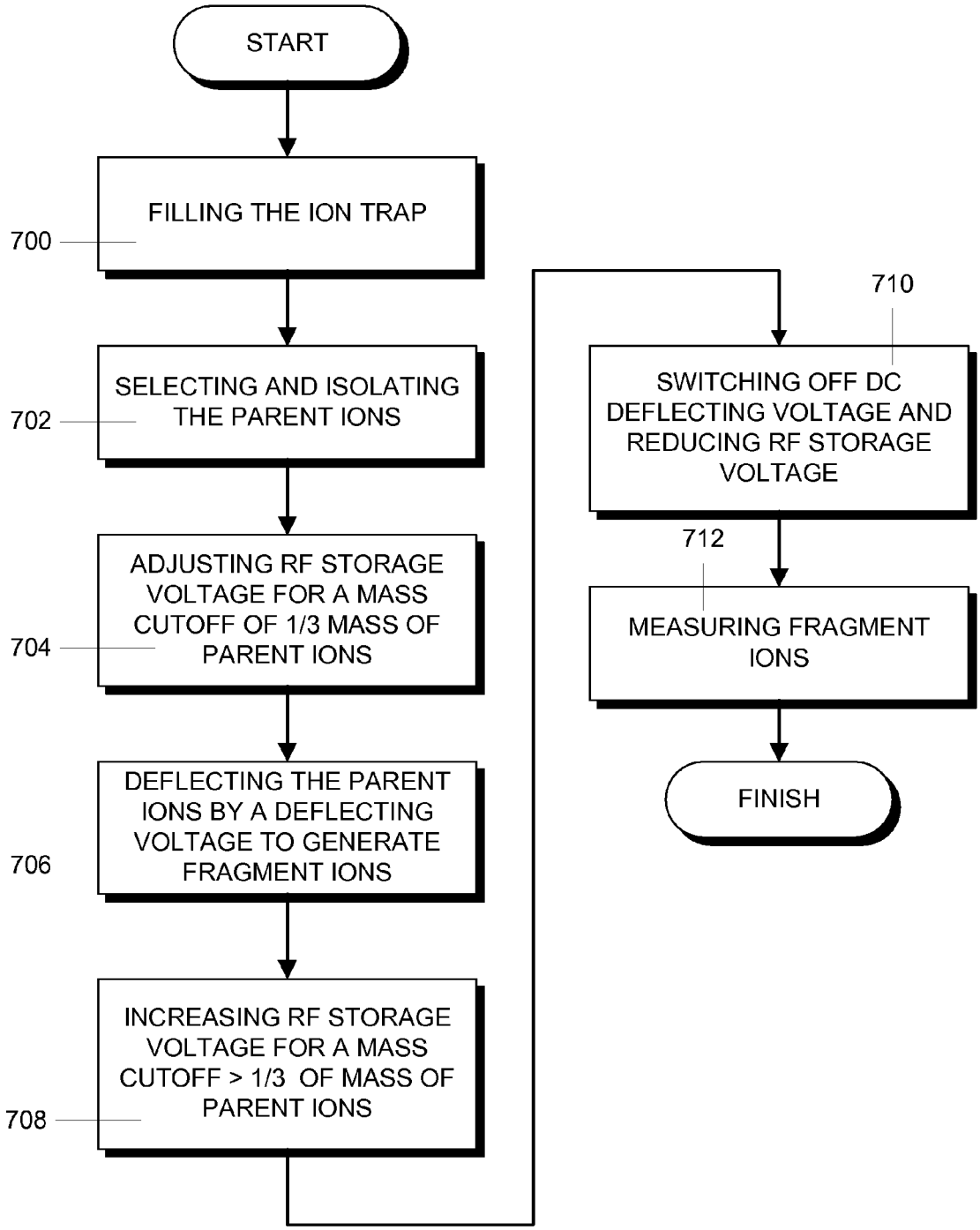
FIG. 7 is a flowchart showing the steps in still another process for measuring light fragment ions in accordance with the invention.

This method is extraordinarily simple and successful. It can also be modified in a variety of ways, however. For example, it is possible to apply potentials of opposite polarity to the two end caps instead of using only one potential asymmetrically. Still another alternative is shown in FIG. 7. Steps 700-702 are the same as steps 600-602 in the method shown in FIG. 6. The method can also start with a moderate RF storage voltage with a value such that the trap cutoff mass is roughly ⅓ the mass of the parent ions as set forth in step 704, and after deflection of the ion cloud by the application of a DC deflecting voltage in step 706, in step 708, the amplitude of the RF storage voltage is intermittently increased to a value such that the trap cutoff mass is greater than ⅓ the mass of the parent ions, before the DC is switched off and the RF voltage is powered down in step 710. The light fragment ions are then measured in step 712.

This embodiment can also be modified even further by exciting the ions again for a short time with an RF excitation voltage after switching off the DC potentials so that their oscillation amplitudes during this time are not reduced by the damping. It is then necessary to begin the excitation in phase, however.

The question is when exactly the light ions are created. It may be assumed (there are strong indications) that they do not occur spontaneously but that the parent ions already exist for a period of time as overexcited, so-called metastable ions before they decompose with a first half-life time to daughter ions, and that metastable daughter ions which are still overexcited dissociate with a further half-life time to granddaughter ions. It can be assumed that, for energetic reasons, the second half-lifetime is greater than the first, so that the granddaughter ions only occur at a time in which they can also be stored after the RF storage voltage is powered down to the lower value.

The specialist can easily implement these fragmentation methods. For commercial ion trap mass spectrometers it is generally only necessary to change the software control; all the voltage generators required are usually provided. The control can be changed by means of a simple software operation. In some commercial ion trap mass spectrometers, it is even possible for the user to undertake the changes to the control procedure, depending on the software version.

What is claimed is:

1. A method for generating and measuring light fragment ions from selected parent ions in an ion trap of an ion trap mass spectrometer that uses an RF storage voltage to produce a pseudopotential for retaining ions and is filled with collision gas, comprising the steps of:

(a) filling the ion trap with ions, (b) selecting and isolating parent ions to be fragmented, each of the parent ions having a mass, (c) adjusting the RF storage voltage so that a cut-off mass for ion trap storage is higher than one third of the mass of the parent ions, (d) deflecting the parent ions by applying a deflecting DC voltage to the ion trap for a time period sufficient for an equilibrium to occur between forces on the parent ions produced by the pseudopotential of the ion trap and by the deflecting DC voltage, (e) switching off the deflecting DC voltage so that the parent ions oscillate in the pseudopotential of the ion trap and undergo collisions with the collision gas in the trap to generate light fragment ions, and reducing, in a controlled way, the RF storage voltage amplitude to an amplitude which permits ion trap storage of the light fragment ions, and (f) measuring the light fragment ions produced.

2. The method according to claim 1, wherein the RF storage voltage is increased in step (c) so that the cut-off mass for ion storage is around one half of the mass of the parent ions.

3. The method according to claim 1, wherein the ion trap is a 3-D ion trap having end cap electrodes, and the deflecting DC voltage is applied to at least one of the end cap electrodes of the ion trap.

4. The method according to claim 1, wherein the reduction of the RF storage voltage in step (e) takes place at such a speed that the amplitude of the oscillations of the ions in the ion trap does not increase.

5. The method according to claim 4, wherein the reduction of the RF storage voltage in step (e) takes place linearly.

6. The method according to claim 4, wherein the reduction of the RF storage voltage in step (e) takes place as a falling exponential function towards a lower voltage limit.

7. The method according to claim 1, wherein the RF storage voltage is increased in step (c) so that the cut-off mass for ion storage is between one third and two thirds of the mass of the parent ions.

8. A method for generating and measuring light fragment ions from selected parent ions in an ion trap of an ion trap mass spectrometer that uses an RF storage voltage to produce a pseudopotential for retaining ions and is filled with collision gas, comprising the steps of:

(a) filling the ion trap with ions, (b) selecting and isolating parent ions to be fragmented, each of the parent ions having a mass, (c) adjusting the RF storage voltage so that a cut-off mass for ion trap storage amounts to roughly one third of the mass of the parent ions, (d) deflecting the parent ions by applying a deflecting DC voltage to the ion trap for a time period sufficient for an equilibrium to occur between forces on the parent ions produced by the pseudopotential of the ion trap and by the deflecting DC voltage, (e) increasing the RF storage voltage so that the cut-off mass for ion trap storage increases to values higher than one third of the mass of the parent ions, switching off the deflecting DC voltage so that the parent ions oscillate in the pseudopotential of the ion trap and undergo collisions with the collision gas in the trap to generate light fragment ions, and reducing, in a controlled way, the RF storage voltage amplitude to an amplitude which permits ion trap storage of the light fragment ions, and (f) measuring the light fragment ions produced.

9. A method for generating and measuring light fragment ions from selected parent ions in an ion trap of an ion trap mass spectrometer that uses an RF storage voltage to produce a pseudopotential for retaining ions and is filled with collision gas, comprising the steps (a) filling the ion trap with ions, (b) selecting and isolating parent ions to be fragmented, each of the parent ions having a mass, (c) adjusting the RF storage voltage so that the cut-off mass for ion trap storage is higher than one third of the mass of the parent ions, (d) deflecting the parent ions by applying a deflecting DC voltage to the ion trap for a time period sufficient for an equilibrium to occur between forces on the parent ions produced by the pseudopotential of the ion trap and by the deflecting DC voltage in order to generate light fragment ions, (e) reducing the deflecting DC voltage and the RF storage voltage in such a manner that forces on the light fragment ions produced by the pseudopotential of the RF storage voltage and by the deflecting DC voltage remain in equilibrium until the RF storage voltage reaches an amplitude which permits ion trap storage of light fragment ions, and (f) measuring the light fragment ions produced.

* * * * *